United States Patent [19]

Sharff

[11] 4,358,156

[45] Nov. 9, 1982

[54] FOOT REST AND ACTUATOR FOR CHAIRS FOR PATIENTS AND INVALIDS

[76] Inventor: Harold M. Sharff, 11 Gardner Rd., Brookline, Mass. 01246

[21] Appl. No.: 135,209

[22] Filed: Mar. 28, 1980

[51] Int. Cl.[3] ..... A47C 7/50

[52] U.S. Cl. ..... 297/434; 297/436; 297/432

[58] Field of Search ..... 297/433, 434, 432, DIG. 10, 297/436, 429

[56] References Cited

U.S. PATENT DOCUMENTS

| | | | |
|---|---|---|---|
| 628,983 | 7/1899 | Jones | 297/434 |
| 630,159 | 8/1899 | Archer | 297/433 X |
| 1,236,517 | 8/1917 | Wemple et al. | 297/433 X |
| 1,710,821 | 4/1929 | Hackney | 297/433 X |
| 3,000,632 | 9/1961 | Fuchs | 297/433 X |
| 3,087,757 | 4/1963 | Fidel | 297/434 |

FOREIGN PATENT DOCUMENTS

| | | | |
|---|---|---|---|
| 282167 | 2/1915 | Fed. Rep. of Germany | 297/433 |

*Primary Examiner*—Francis K. Zugel

*Attorney, Agent, or Firm*—Charles R. Fay

[57] ABSTRACT

A chair comprising a relatively elevated seat with an adjustable pivoted foot rest which can be positioned in useful or out-of-the-way positions, including easily operable manual means for the occupant to move the foot rest, for the purpose of providing a comfortable foot support for invalids, particularly arthritics, and to allow them to more easily enter and leave the chair.

5 Claims, 2 Drawing Figures

FOOT REST AND ACTUATOR FOR CHAIRS FOR PATIENTS AND INVALIDS

BACKGROUND OF THE INVENTION

There are many invalid chairs and particularly in point are chairs which have power assist seats to help an infirm or arthritic person rise from the chair. In the present case no power operated parts are used, the seat for the chair being elevated and the foot rest being adjustable and swung by the occupant to useful or out-of-the-way position, so that the patient or arthritic person may be seated with the least difficulty and may more easily get out of the chair with the least aid and with the least difficulty.

SUMMARY OF THE INVENTION

A chair is provided with a padded seat in a fixed position with relation to its supporting floor. This seat is elevated with respect to a normal chair so that the arthritic person or invalid may simply lean back on it and be seated with the least trouble. That is, the forward edge of the chair seat strikes an adult well above the knees. A pivoted foot rest is provided which may be placed in out-of-the-way position where it is not used and where it does not interfere with the person standing in front of the chair preparatory to being seated therein or to rising from the chair. The foot rest can be pivoted out and is vertically adjustable for the purpose of best supporting the feet of the occupant of the chair. The foot rest is solidly supported at four corners and is a safety feature as the chair will not pivot over frontwards if the patient stands on the foot rest.

However, in order to assist the patient in getting in and out of the chair, manually operable lever and link means is provided, selectively at either side of the chair, for the patient to operate himself to pivot the foot rest down to useful substantially horizontal position, or to pivot it back within the confines of the chair where it is out-of-the-way and does not interfere with the patient getting into or out of the chair.

PREFERRED EMBODIMENT OF THE INVENTION

Figure 1:
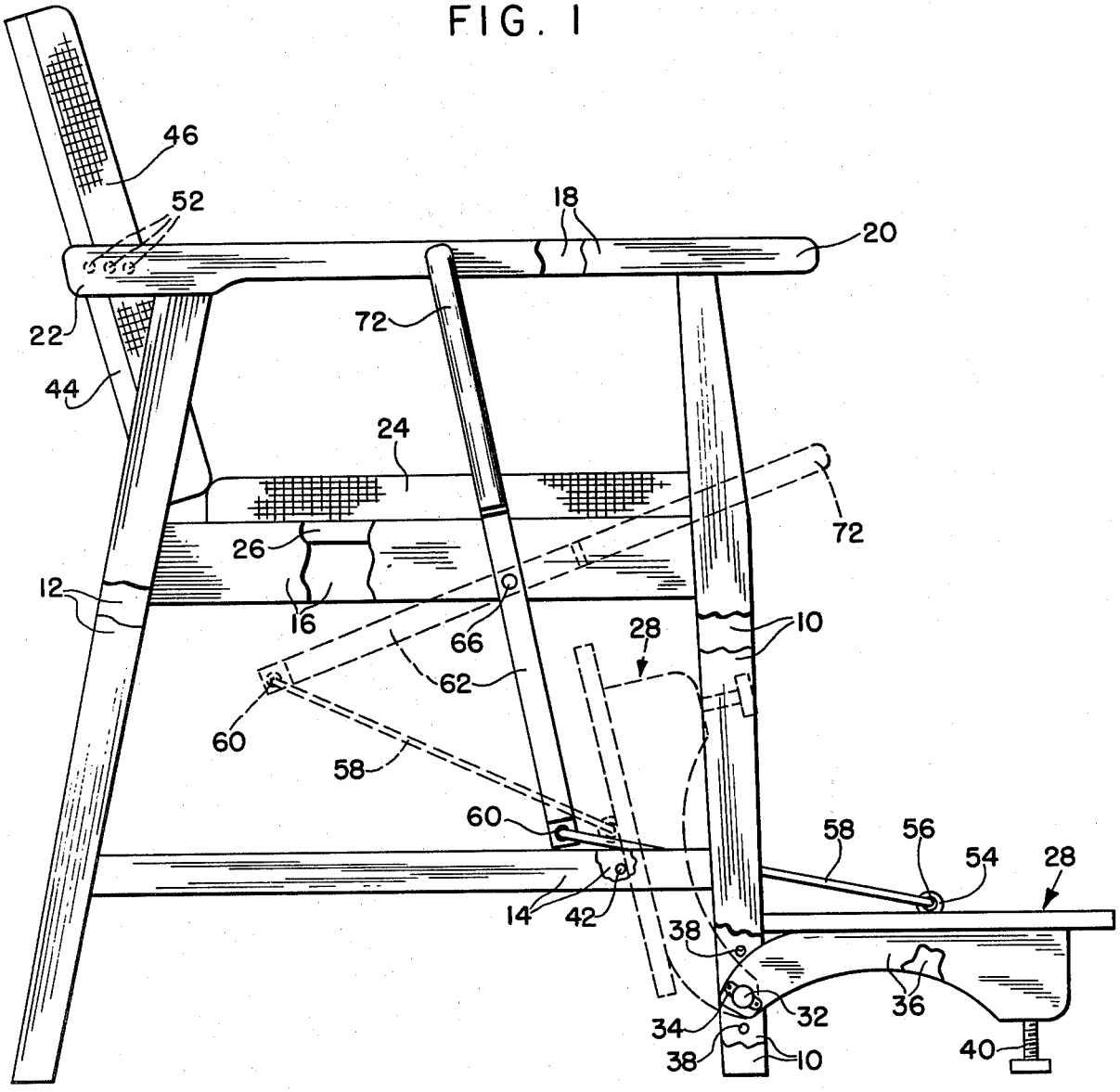
FIG. 1 is a view in side elevation with parts broken away illustrating the invention.
Figure 2:
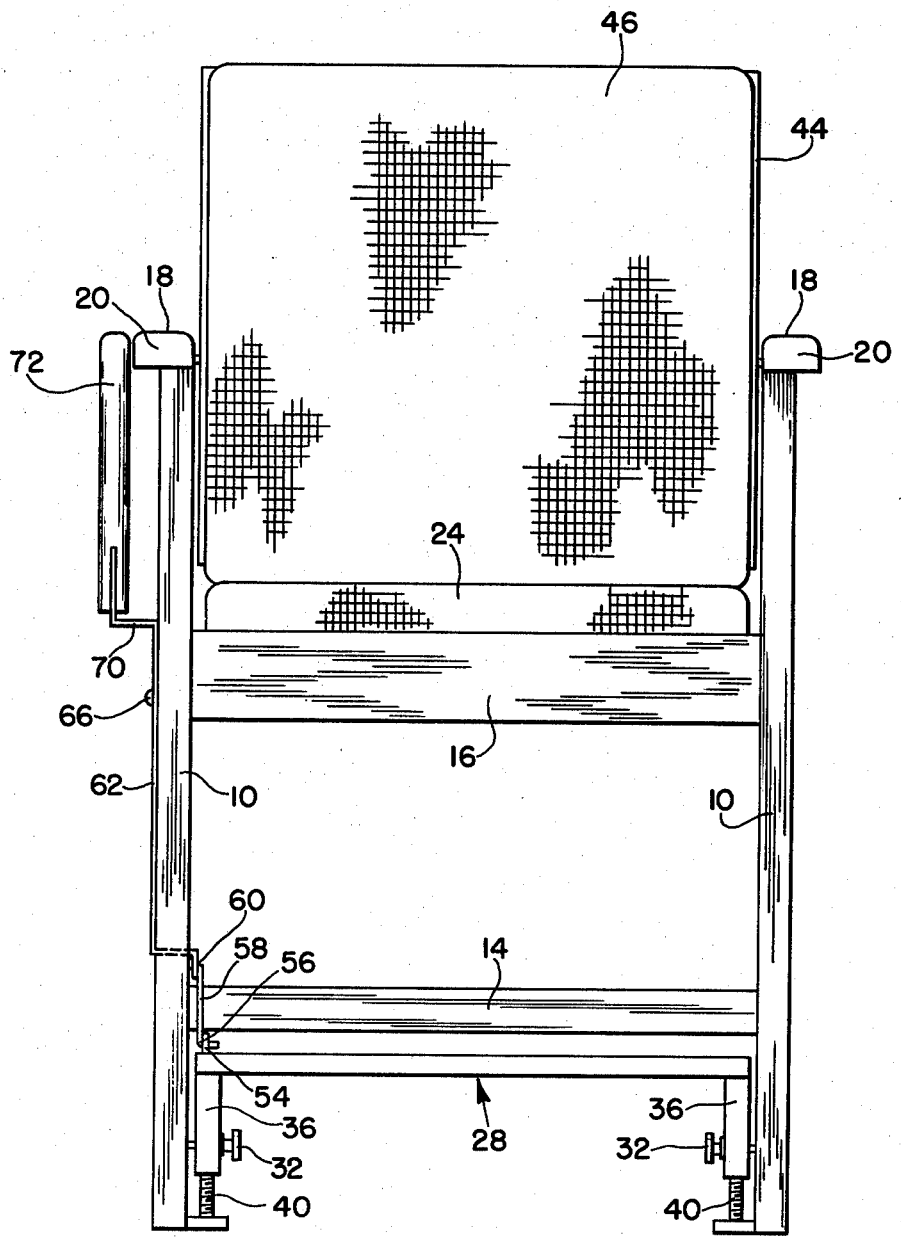
FIG. 2 is a front view of a portion of the chair.

The chair disclosed in this application has two front legs 10,10 and two rear legs 12,12 separated by reaches such as those at 14,14 and 16,16. The legs extend upwards slightly slanted toward each other and at their top ends are joined by arm rests 18,18. These arm rests preferably extend forwardly of front legs 10 as at 20 and rearwardly of rear legs 12 as at 22. A pad 24 is preferably provided on the seat which may be as generally shown at 26 extending front to rear and side to side of the chair. The seat is at an elevation so that it will coincide with an adult patient well above the knees in the region of the upper portions of the thighs.

A foot rest generally indicated at 28 is pivotally mounted as by a pair of pins 32. These pins are slidingly located in brackets 34 mounted on the rear end of a pair of spaced foot rest supports 36,36. The pins 32 are retractable and replaceable in a series of vertically spaced openings or the like 38 in the front legs 10 for vertically positioning the foot rest at a desired elevation. The forward portions of the foot rest supports 36,36 each has a screw threaded support 40 to accommodate the adjustment and to keep the foot rest more or less level or slightly slanted according to the desire or convenience of the occupant of the chair.

As shown in dotted lines in FIG. 1, the foot rest may be pivoted inwardly with respect to the chair, coming to rest against stops 42 or the like, in which position it is completely out of the way and the patient may stand in front of the chair facing away from the same.

The back rest is provided with a frame 44. This frame may have a pad 46 thereon and it is provided with adjusting means e.g. holes 52 for the selective reception of pins, not shown, for a pivoted adjustment. At the lower end of the frame 44 the same may be provided with a pivot pin not shown.

Therefore, the patient more easily and safely sits down and is placed in a comfortable position, the foot rest being adjusted to suit, as is the back rest.

The foot rest is provided with a connection e.g. an eye 54 for the reception of an offset 56 on the end of a link 58 pivoted at its opposite end to the lower end 60 of a lever 62. This lower lever end is offset extending inward under the seat so that the link 58 is inboard of the legs of the chair. The main part of the lever 62 is outboard. The eye 54 is intermediate the front and rear edges of the foot rest 28, and is pivoted at 66 to the reach 16. The lever terminates in offset 70 and a turned up end securing a handle 72 thereto.

This device is made so that it can be placed on the right or left reach 16, to accommodate patients who may have the use of only one hand.

The function of the device is easily seen in FIG. 1. When the foot rest is housed, dotted lines in FIG. 1, the patient can more easily get into and out of the chair. Once seated, the patient grasps handle 72 and brings up to the solid line position, extending the foot rest to operating position, and by reversing this action, places the foot rest out of the way if not wanted.

This chair is also used for post operative care of post surgical total hips and total knee patients, and it has proved to be excellent with respect to maintenance of body position and extremity alignment. The design allows for ease of entry and exit for patients with functional impairment and provides additional safety benefits when transfer activities are attempted. In addition to the orthopedic and safety features, most remarkable has been patient acceptance and enthusiasm for use. Designed because of the long standing need for individuals with functional limitations that have difficulty getting in and out of conventional seating, the chair has a 3-position back support and the retractable foot rest adjusts to 4 positions and can be raised and lowered by the touch lever handle at arm-rest height.

I claim:

1. A chair for invalids and patients comprising front and rear legs, a seat connecting the legs, said seat including a front edge located at a height above the knees of an adult, the legs rising above the seat, and arm rests secured to the top portions of the legs above the seat, one arm rest on eitherside of the seat, a foot rest, means pivoting the foot rest at its rear edge to the lower portions of the front legs of the chair, and floor engaging means adjustably supporting the forward portion of the footrest in horizontal or slightly slanted positions, said foot rest being pivotable from the substantially horizontal to a substantially vertical position, the foot rest in vertical position lying within the confines of the legs of the chair, and the horizontal position of the foot rest being forwardly of the chair, means to move the foot rest between the two positions thereof, said foot rest moving means including a movable handle having a portion thereof adjacent an arm rest for actuation by the occupant of the chair, and a lever connected to said handle, a pivot for the lever on the chair, a link, the end of the lever opposite the handle being engaged with the link, and means connecting the link with the foot rest.

2. The chair of claim 1 including means to vertically adjust the foot rest pivot with respect to the front legs of the chair.

3. The chair of claim 1 including a support behind the front legs of the chair for supporting the foot rest in generally vertical position.

4. The chair of claim 1 wherein the pivot for the lever and the connection between the link and the foot rest are removable for selective application of the foot rest moving means to a position adjacent the opposite arm rest.

5. The chair of claim 1 including a generally horizontal member connecting the front and rear legs just below the seat, the pivot for the foot rest moving lever being located in said element but being removable therefrom.

* * * * *